US007621138B2

(12) United States Patent
Lee et al.

(10) Patent No.: US 7,621,138 B2
(45) Date of Patent: Nov. 24, 2009

(54) ABNORMAL STATE DETECTING APPARATUS OF MULTI-TYPE AIR CONDITIONER AND METHOD THEREOF

(75) Inventors: Yoon-Been Lee, Seoul (KR); Se-Dong Chang, Gyeonggi-Do (KR); Song Choi, Seoul (KR); Baik-Young Chung, Incheon (KR)

(73) Assignee: LG Electronics Inc., Seoul (KR)

( * ) Notice: Subject to any disclaimer, the term of this patent is extended or adjusted under 35 U.S.C. 154(b) by 532 days.

(21) Appl. No.: 11/128,336

(22) Filed: May 13, 2005

(65) Prior Publication Data

US 2006/0086103 A1 Apr. 27, 2006

(30) Foreign Application Priority Data

Oct. 26, 2004 (KR) ..... 10-2004-0085920

(51) Int. Cl.
*G01K 13/00* (2006.01)
*F25B 7/00* (2006.01)

(52) U.S. Cl. ..... 62/129; 62/130; 62/175; 236/1 B

(58) Field of Classification Search ..... 62/126, 62/127, 129, 130, 175
See application file for complete search history.

(56) References Cited

U.S. PATENT DOCUMENTS 4,381,549 A * 4/1983 Stamp et al. ..... 62/126
5,115,967 A * 5/1992 Wedekind ..... 236/46 R
5,123,254 A * 6/1992 Inoue et al. ..... 62/126
5,241,833 A 9/1993 Ohkoshi
5,974,813 A * 11/1999 Jeong ..... 62/127
5,979,167 A * 11/1999 Kochavi et al. ..... 62/186
6,324,854 B1 * 12/2001 Jayanth ..... 62/127
6,843,425 B2 1/2005 Lee
6,978,627 B2 * 12/2005 Masui et al. ..... 62/127
2002/0059803 A1 5/2002 Jayanth

FOREIGN PATENT DOCUMENTS

| | | |
|---|---|---|
| EP | 1209427 | 5/2002 |
| EP | 1335166 | 8/2003 |
| JP | 57-131953 | 8/1982 |
| JP | 58-075649 | 5/1983 |

OTHER PUBLICATIONS

English Language Abstract of JP 58-075649.
English Language Abstract of JP 57-131953.

* cited by examiner

*Primary Examiner*—Marc E Norman
(74) *Attorney, Agent, or Firm*—KED & Associates, LLP

(57) ABSTRACT

Disclosed are an abnormal state detecting apparatus of a multi-type air conditioner and a method thereof. The method comprises: a user's selecting a test operation, and then detecting plural indoor temperatures of indoor zones where a plurality of indoor units are installed and plural outdoor temperatures of outdoor zones where a plurality of outdoor units are installed; selecting a corresponding test operation mode among a plurality of test operation modes preset according to an average indoor temperature of the detected plural indoor temperatures and an average outdoor temperature of the detected plural outdoor temperatures; test-operating the multi-type air conditioner according to the selected test operation mode, and collecting data showing an operation state of the test-operated air conditioner; and comparing the collected data with a preset reference data and judging an abnormal state of the multi-type air conditioner based on the comparison result.

21 Claims, 4 Drawing Sheets

ABNORMAL STATE DETECTING APPARATUS OF MULTI-TYPE AIR CONDITIONER AND METHOD THEREOF

BACKGROUND OF THE INVENTION

1. Field of the Invention

The present invention relates to a multi-type air conditioner, and more particularly, to an abnormal state detecting apparatus of a multi-type air conditioner and a method thereof.

2. Description of the Conventional Art

Generally, an air conditioner is an apparatus for controlling the temperature, humidity, the air current, and a clean degree of indoor air for a comfortable indoor atmosphere. According to a construction of units, the air conditioner is largely divided into an integration type air conditioner that an indoor unit and an outdoor unit are mounted in a single case and a separation type air conditioner that a compressor and a condenser are constructed as an outdoor unit and an evaporator is constructed as an indoor unit.

The separation type air conditioner comprises a cooling/heating air conditioner for selectively performing a cooling operation and a heating operation of the air conditioner by switching a flow path of a refrigerant by a flow path switching valve.

Recently, a multi-type air conditioner having a plurality of indoor units for performing a cooling operation or a heating operation according to each space is being increasingly used. The multi-type air conditioner is provided with a plurality of outdoor units respectively having a plurality of compressors in parallel so as to correspond to a driving load of indoor units.

FIG. 1 is a view showing a construction of outdoor units of a multi-type air conditioner in accordance with the conventional art.

As shown, the conventional multi-type air conditioner is provided with a plurality of outdoor units (11*a*~11*n*), and a plurality of indoor units (not shown).

The plural outdoor units respectively comprises a pair of first and second compressors 13*a* and 13*b* for compressing a refrigerant, a four-way valve 21 for switching a flow path of the refrigerant, an outdoor heat exchanger 25 for exchanging heat of the refrigerant, and an accumulator 27 for providing a refrigerant of a gaseous state to the first compressor 13*a* and the second compressor 13*b*.

The first compressor 13*a* and the second compressor 13*b* are respectively provided with a discharge pipe 15 for discharging a refrigerant at an upper region thereof, and is provided with a suction pipe 17 of which one side is connected to an accumulator 27 in order to suck a refrigerant at a lower region thereof. An oil balancing pipe 19 for uniformly supplying oil to the first compressor 13*a* and the second compressor 13*b* is connected between the first compressor 13*a* and the second compressor 13*b*.

The first compressor 13*a* and the second compressor 13*b* are provided with an oil separator 31 for separating oil from a refrigerant and a check valve 33 at each discharge side thereof, respectively. The oil separator 31 is provided with an oil recollecting path 35 for recollecting separated oil to each suction side of the first compressor 13*a* and the second compressor 13*b*.

A four-way valve 21 for switching a flow path of a refrigerant is provided at a lower side of the check valve 33. The outdoor heat exchanger 25 is connected to a first port of the four-way valve 21, and the accumulator 27 is connected to a second port of the four-way valve 21. Also, one end of a connection pipe 41 connected to the indoor unit is connected to a third port of the four-way valve 21.

A receiver 37 is provided at one side of the outdoor heat exchanger 25 along a flow direction of a refrigerant. Service valves 43*a* and 43*b* are respectively provided at each one side of the receiver 37 and the connection pipe 41. Each one side of the service valves 43*a* and 43*b* is connected to a main refrigerant pipe 45 for connecting the outdoor units 11*a*~11*n* one another.

The conventional multi-type air conditioner is provided with a plurality of indoor units (first to $N^{th}$ indoor unit) and a plurality of outdoor units (first to $M^{th}$ outdoor unit) connected to one another.

FIG. 2 is a schematic diagram showing a state that plural outdoor units (first to $M^{th}$ outdoor unit) are connected to plural indoor units (first to $N^{th}$ indoor unit).

The plural outdoor units are connected to the plural indoor units by a communication wire, and one of the plural outdoor units is operated by a central controller. The outdoor unit operated by the central controller controls other outdoor units and the plural indoor units (first to $N^{th}$ indoor unit) for a cooling operation or a heating operation.

A user drives the indoor units by using a remote controller, the central controller, etc. of the multi-type air conditioner thusly to check whether a cooling operation of a heating operation of the air conditioner is well performed, thereby checking an abnormal state of the multi-type air conditioner.

However, at the time of installing the plural indoor units and the plural outdoor units of the multi-type air conditioner, an installation inferiority such as an inferior pipe connection, a mis-connection of a communication wire, etc. or a mechanical damage may be generated.

That is, in the conventional multi-type air conditioner, an abnormal state such as an inferior installation or a mechanical damage of the air conditioner is not precisely checked due to a complicated structure of the air conditioner, thereby degrading a function of the air conditioner or causing a mechanical damage of the air conditioner.

SUMMARY OF THE INVENTION

Therefore, an object of the present invention is to provide an abnormal state detecting apparatus of a multi-type air conditioner capable of detecting an abnormal state of the multi-type air conditioner by operating the multi-type air conditioner in different test operation modes according to indoor and outdoor temperatures and then by comparing characteristic data showing an operation state of the multi-type air conditioner being operated with a preset reference data at the time of a test operation, and a method thereof.

To achieve these and other advantages and in accordance with the purpose of the present invention, as embodied and broadly described herein, there is provided an abnormal state detecting apparatus of a multi-type air conditioner comprising: a plurality of indoor temperature sensors RT1~RTn for detecting indoor temperatures of indoor zones where a plurality of indoor units are positioned; a plurality of outdoor temperature sensors 0T1~0Tn for detecting outdoor temperatures of outdoor zones where a plurality of outdoor units are positioned; and a micro computer for judging an abnormal state of the multi-type air conditioner by selecting a corresponding test operation mode among a plurality of test operation modes preset according to an average indoor temperature of the detected plural indoor temperatures and an average outdoor temperature of the detected plural outdoor temperatures, by test-operating the multi-type air conditioner according to the selected test operation mode, then by collecting data showing an operation state of the test-operated air conditioner, and then by comparing the collected data with a preset reference data.

To achieve these and other advantages and in accordance with the purpose of the present invention, as embodied and broadly described herein, there is also provided a method for detecting an abnormal state of a multi-type air conditioner comprising: a user's selecting a test operation, and then detecting plural indoor temperatures of indoor zones where a plurality of indoor units are installed and plural outdoor temperatures of outdoor zones where a plurality of outdoor units are installed; selecting a corresponding test operation mode among a plurality of test operation modes preset according to an average indoor temperature of the detected plural indoor temperatures and an average outdoor temperature of the detected plural outdoor temperatures; test-operating the multi-type air conditioner according to the selected test operation mode, and collecting data showing an operation state of the test-operated air conditioner; and comparing the collected data with a preset reference data, and judging an abnormal state of the multi-type air conditioner based on the comparison result.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Hereinafter, with reference to FIGS. 3 to 5, will be explained an abnormal state detecting apparatus of a multi-type air conditioner capable of detecting an abnormal state of the multi-type air conditioner by operating the multi-type air conditioner in different test operation modes according to indoor and outdoor temperatures and then by comparing characteristic data showing an operation state of the multi-type air conditioner being operated with a preset reference data at the time of a test operation, and a method thereof.

Figure 3:
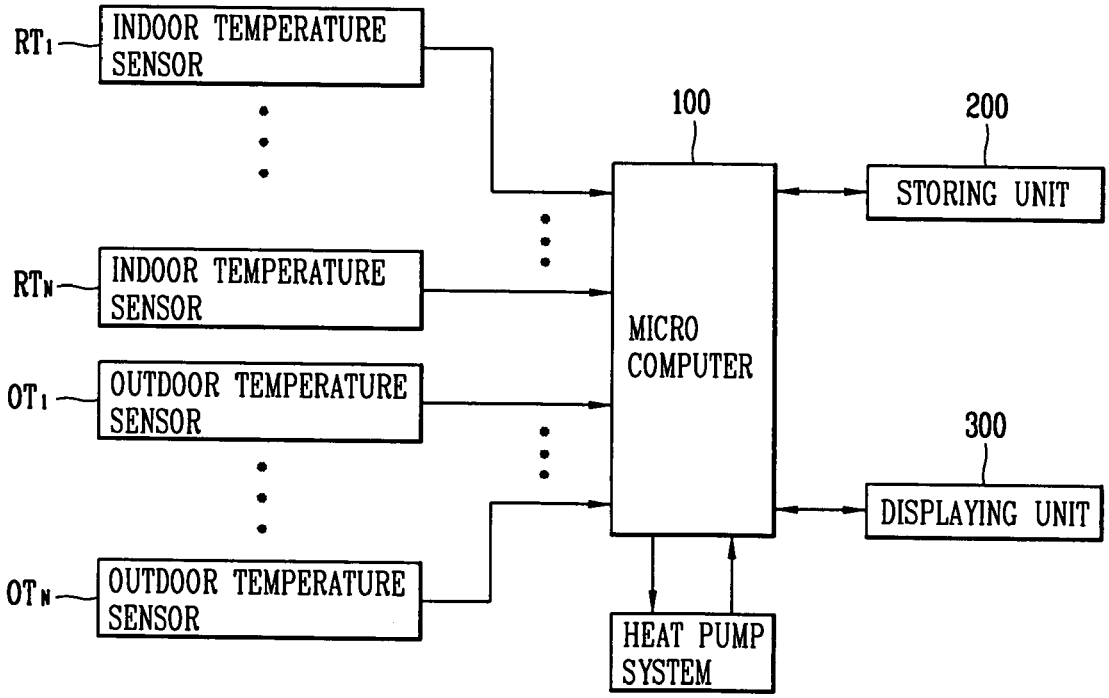
FIG. 3 is a block diagram showing a construction of an abnormal state detecting apparatus of a multi-type air conditioner according to the present invention.

FIG. 3 is a block diagram showing a construction of an abnormal state detecting apparatus of a multi-type air conditioner according to the present invention.

As shown, the abnormal state detecting apparatus of a multi-type air conditioner according to the present invention comprises: a plurality of indoor temperature sensors RT1~RTn for detecting indoor temperatures of indoor zones where a plurality of indoor units are positioned; a plurality of outdoor temperature sensors 0T1~0Tn for detecting outdoor temperatures of outdoor zones where a plurality of outdoor units are positioned; and a micro computer 100 for judging an abnormal state of the multi-type air conditioner by selecting a corresponding test operation mode among a plurality of test operation modes preset according to an average indoor temperature of the detected plural indoor temperatures and an average outdoor temperature of the detected plural outdoor temperatures, by test-operating the multi-type air conditioner according to the selected test operation mode, then by collecting data showing an operation state of the test-operated air conditioner, and then by comparing the collected data with a preset reference data.

The multi-type air conditioner according to the present invention further comprises a storing unit 200 for storing ideal data that indicates a normal operation state of the multi-type air conditioner as a reference data, and for storing information of first to sixth zones divided according to the average indoor temperature and the average outdoor temperature and having different test operation modes. Also, the multi-type air conditioner according to the present invention further comprises a displaying unit 300 for displaying an abnormal state of the multi-type air conditioner judged by the micro computer 100.

The multi-type air conditioner can be realized as several systems. However, the multi-type air conditioner according to the present invention is realized as a heat pump system (HPS). Hereinafter, the multi-type air conditioner realized as a heat pump system will be explained.

Figure 1:
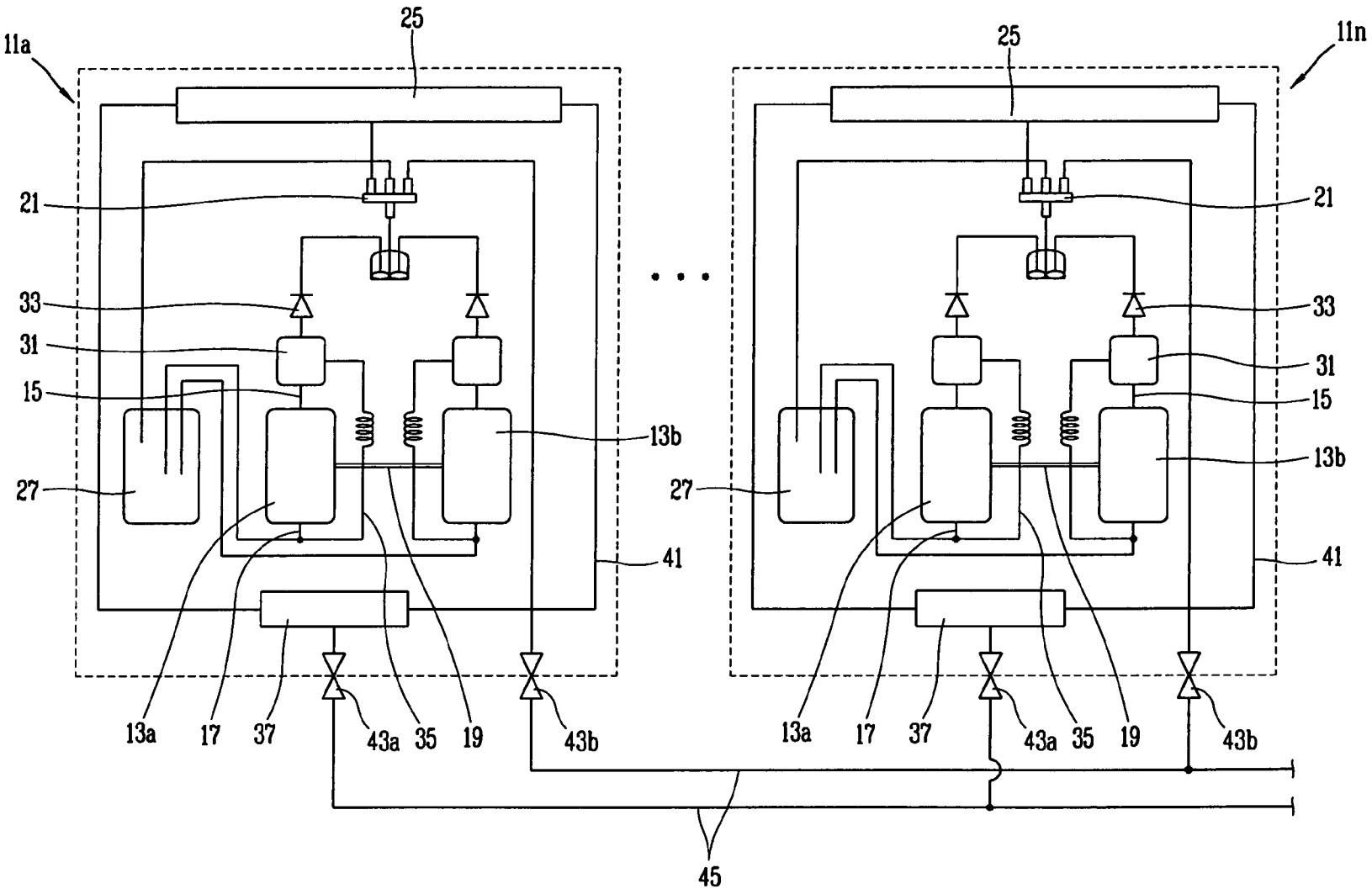
FIG. 1 CONVENTIONAL ART
FIG. 1 is a schematic diagram showing a construction of outdoor units of a multi-type air conditioner in accordance with the conventional art.
Figure 2:
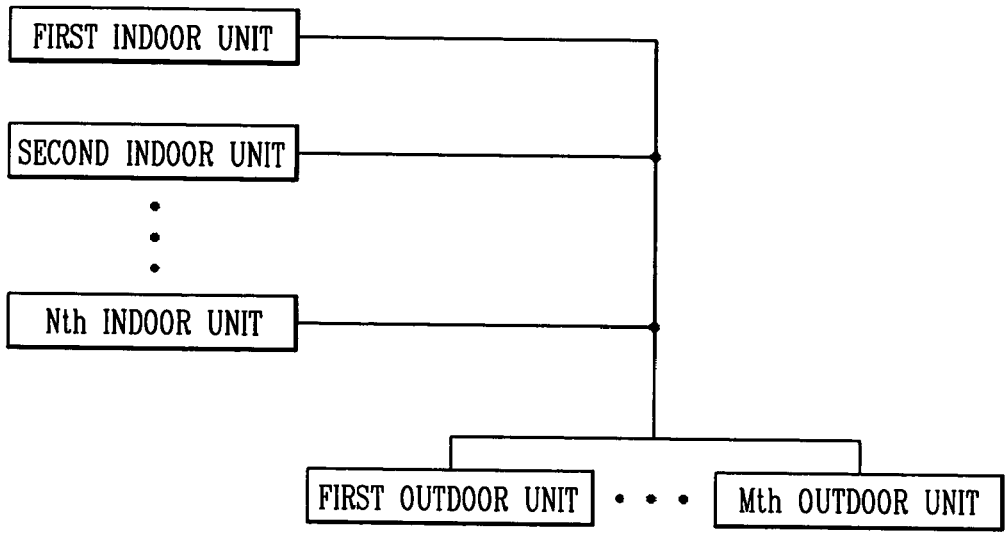
FIG. 2 CONVENTIONAL ART
FIG. 2 is a schematic diagram showing a state that the plural outdoor units of FIG. 1 are connected to plural indoor units.

Since the multi-type air conditioner according to the present invention is realized as a heat pump system, data for showing an operation state of the multi-type air conditioner includes characteristic values of the heat pump system operated in a cooling mode or a heating mode, that is, a value of a high pressure ($P_H$), a value of a low pressure ($P_L$), a value of a compressor discharge temperature, a value of a liquid pipe temperature, a value of a degree of sub-cooling, a value of a degree of superheat, etc. Referring to FIG. 1, the value of a high pressure ($P_H$) denotes a value of a pressure between the check valve 33 and the four-way valve 21. The value of a low pressure ($P_L$) denotes a value of a pressure between the four-way valve 21 and the accumulator 27. Also, the value of a compressor discharge temperature is a value of a temperature between the first and second compressors 13*a* and 13*b* and the oil separator 31. The value of a compressor discharge temperature is measured only for compressors being operated, and the value of a liquid pipe temperature denotes a value of a temperature between the service valve 43*a* and the outdoor heat exchanger 25. The value of a degree of sub-cooling denotes a difference between the liquid pipe temperature and a saturated temperature corresponding to the value of a high pressure $P_H$ on a pressure-enthalpy diagram. Also, the value of degree of superheat denotes a difference between a saturated temperature corresponding to the value of a low pressure $P_L$ and a suction temperature of the compressor on a pressure-enthalpy diagram. The suction temperature of the compressor is measured at an inlet of the first compressor 13*a*, an inlet of the second compressor 13*b*, or an inlet of the accumulator 27.

The micro computer 100 stops the multi-type air conditioner when it is judged that the multi-type air conditioner is in an abnormal state. On the contrary, when it is judged that the multi-type air conditioner is in a normal state, the micro computer 100 stops the test operation of the multi-type air conditioner after collecting oil inside the multi-type air conditioner.

The test operation mode has 6 modes corresponding to first to sixth zones stored in the storing unit 200.

Figure 4:
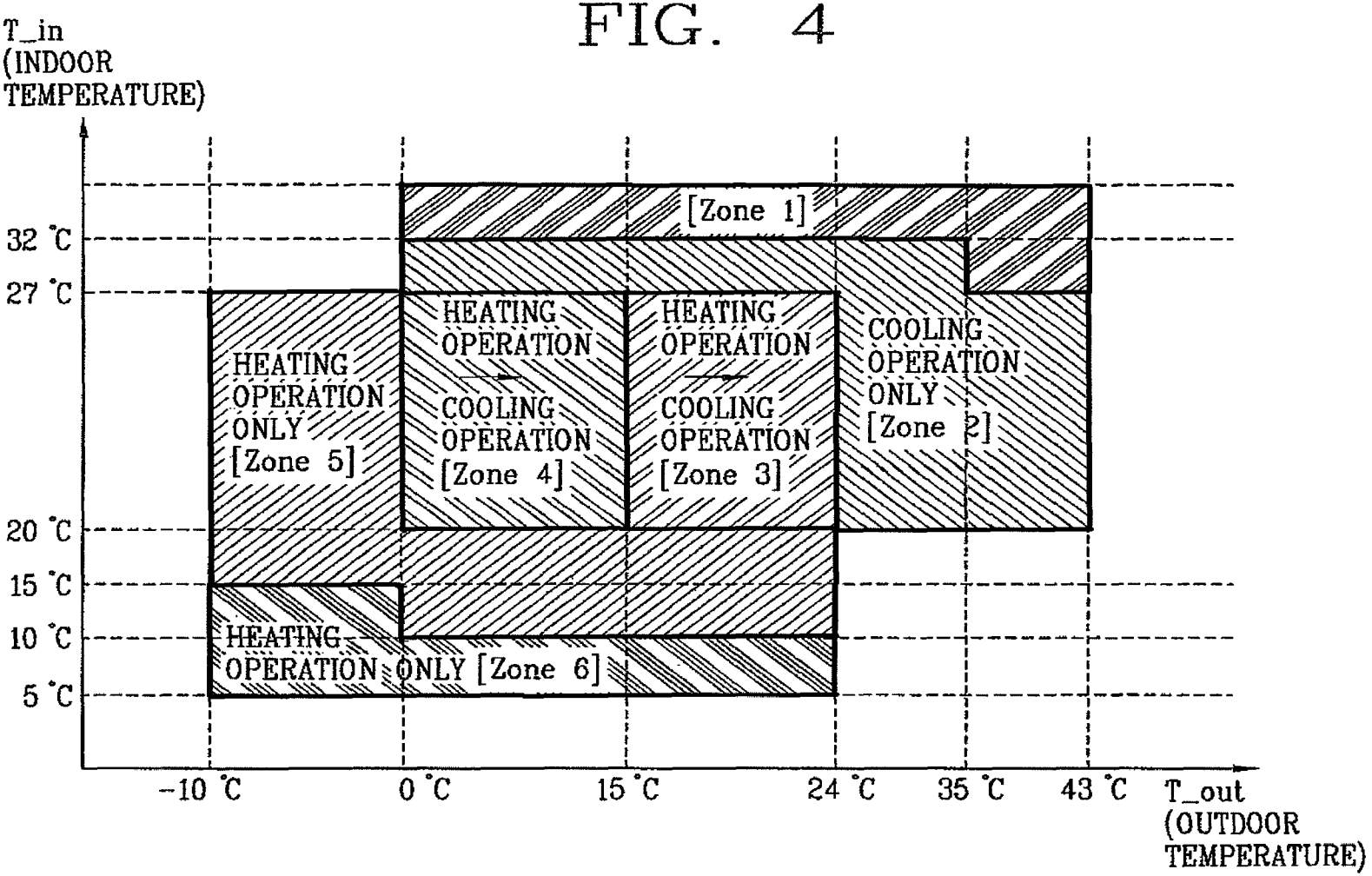
FIG. 4 is a graph showing 6 zones divided according to indoor temperatures and outdoor temperatures by which a test operation mode of the multi-type air conditioner according to the present invention is determined.

FIG. 4 is a graph showing 6 zones divided according to indoor temperatures and outdoor temperatures in FIG. 3.

As shown in FIG. 4, the first zone is composed of a zone that an average indoor temperature is 32° or more than and an average outdoor temperature is in a range of 0° C.~43° C., and a zone that the average indoor temperature is in a range of 27° C.~32° C. and the average outdoor temperature is in a range of 35° C.~43° C. Also, the second zone is composed of a zone that the average indoor temperature is in a range of 20° C.~27° C. and the average outdoor temperature is in a range of 24° C.~43° C., and a zone that the average indoor temperature is in a range of 27° C.~32° C. and the average outdoor temperature is in a range of 24° C.~35° C. The third zone is composed of a zone that the average indoor temperature is in a range of 20° C.~27° C. and the average outdoor temperature is in a range of 15° C.~24° C. The fourth zone is composed of a zone that the average indoor temperature is in a range of 20° C.~27° C. and the average outdoor temperature is in a range of 0° C.~15° C. The fifth zone is composed of a zone that the average indoor temperature is in a range of 15° C.~27° C. and the average outdoor temperature is in a range of −10° C.~0° C., and a zone that the average indoor temperature is in a range of 10° C.~20° C. and the average outdoor temperature is in a range of 0° C.~24° C. And, the sixth zone is composed of a zone that the average indoor temperature is in a range of 5° C.~15° C. and the average outdoor temperature is in a range of −10° C.~0° C., and a zone that the average indoor temperature is in a range of 5° C.~10° C. and the average outdoor temperature is in a range of 0° C.~24° C.

The micro computer drives the multi-type air conditioner according to an average indoor temperature of indoor temperatures detected from the plural indoor temperature sensors and an average outdoor temperature of outdoor temperatures detected from the plural outdoor temperature sensors. Preferably, the average indoor temperature is a weighted average indoor temperature, and the average outdoor temperature is an arithmetic average outdoor temperature.

That is, when the average indoor temperature and the average outdoor temperature correspond to the first zone, the multi-type air conditioner is operated in a cooling mode for a preset time thereby to lower the average indoor temperature by a preset temperature. Then, it is judged whether the average outdoor temperature and the lowered average indoor temperature correspond to the second zone. If the average outdoor temperature and the lowered average indoor temperature correspond to the second zone, the multi-type air conditioner is test-operated in a test operation mode corresponding to the second zone. However, if the average outdoor temperature and the lowered average indoor temperature do not correspond to the second zone, the test-operation of the multi-type air conditioner is stopped and the stopped state of the multi-type air conditioner is displayed.

In a test-operation mode of the multi-type air conditioner when the average indoor temperature and the average outdoor temperature correspond to the second zone, only half of the plural indoor units are operated in a cooling mode for a preset time and the rest half of the plural indoor units are not operated. The indoor units may be operated for a preset number of times with alternation.

In a test-operation mode of the multi-type air conditioner when the average indoor temperature and the average outdoor temperature correspond to the third zone, all the plural indoor units are operated in a cooling mode for a preset time. It is also possible to operate some indoor units (for example, 50%) for a preset time before operating all the plural indoor units.

In a test-operation mode of the multi-type air conditioner when the average indoor temperature and the average outdoor temperature correspond to the fourth zone, all the plural indoor units are operated in a heating mode for a preset time. It is also possible to operate some indoor units (for example, 50%) for a preset time before operating all the plural indoor units.

In a test-operation mode of the multi-type air conditioner when the average indoor temperature and the average outdoor temperature correspond to the fifth zone, only half of the plural indoor units are operated in a heating mode for a preset time and the rest of the plural indoor units are not operated. The indoor units may be operated for a preset number of times with alternation.

When the average indoor temperature and the average outdoor temperature correspond to the sixth zone, the multi-type air conditioner is operated in a heating mode for a preset time thereby to increase the average indoor temperature by a preset temperature. Then, it is judged whether the average outdoor temperature and the increased average indoor temperature correspond to the fifth zone. If the average outdoor temperature and the increased average indoor temperature correspond to the fifth zone, the multi-type air conditioner is test-operated in a test operation mode corresponding to the fifth zone. However, if the average outdoor temperature and the increased average indoor temperature do not correspond to the fifth zone, the test-operation of the multi-type air conditioner is stopped and the stopped state of the multi-type air conditioner is displayed.

Then, the micro computer 100 compares data for indicating an operation state of the multi-type air conditioner test-operated in different test operation modes with a preset reference data, and judges whether the multi-type air conditioner is in an abnormal state on the basis of the comparison result.

For example, when an error between the data for indicating an operation state of the multi-type air conditioner and the preset reference data is more than 30% as the result of the comparison, the micro computer judges as that the multi-type air conditioner is in an abnormal state.

Hereinafter, an operation of the abnormal state detecting apparatus of a multi-type air conditioner will be explained with reference to FIG. 5.

Figure 5:
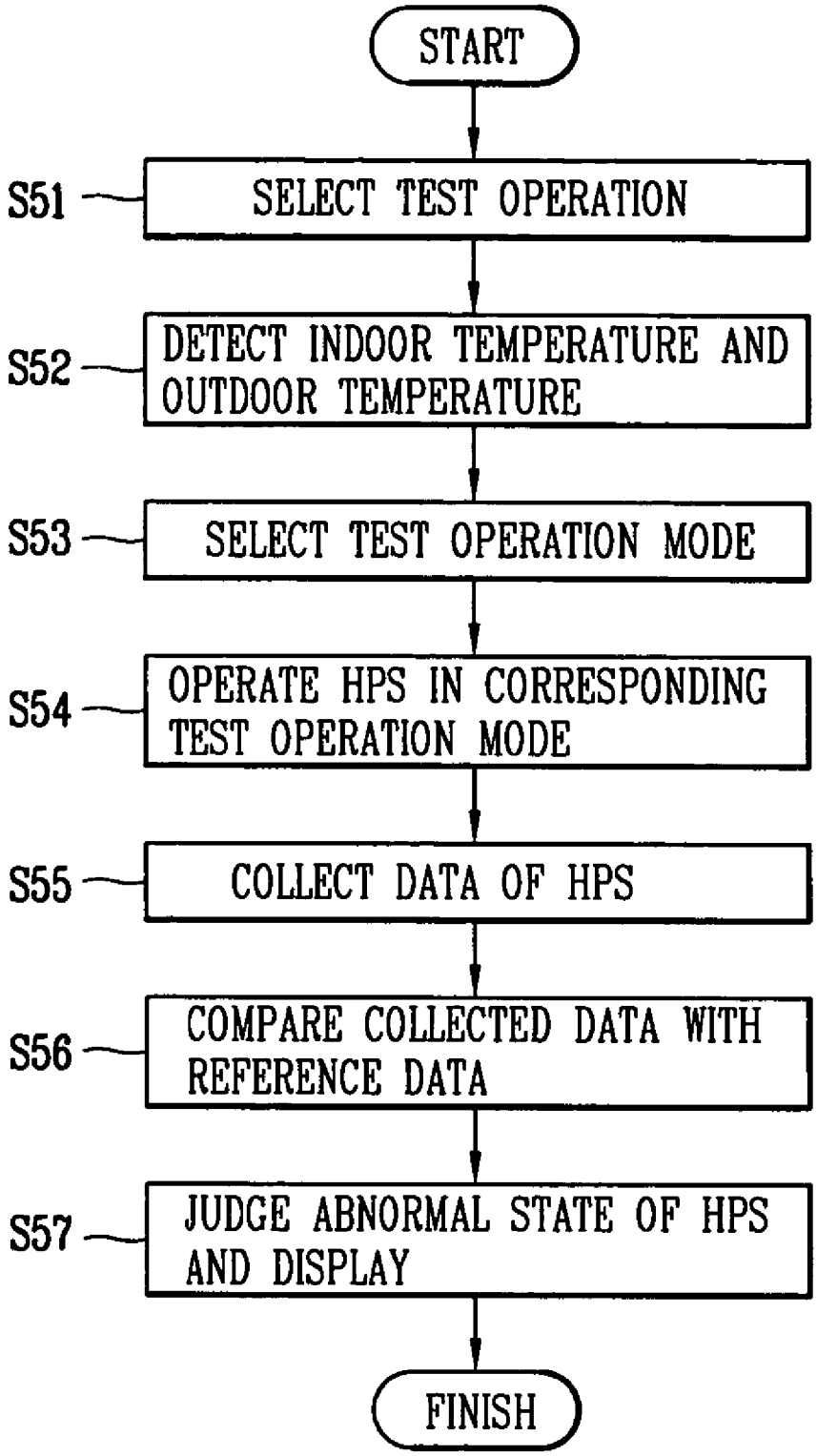
FIG. 5 is a flowchart showing a method for detecting an abnormal state of the multi-type air conditioner according to the present invention.

FIG. 5 is a flowchart showing a method for detecting an abnormal state of the multi-type air conditioner according to the present invention.

As shown, the method for detecting an abnormal state of a multi-type air conditioner comprises a user's selecting a test operation (S51) and then detecting plural indoor temperatures of indoor zones where a plurality of indoor units are installed and plural outdoor temperatures of outdoor zones where a plurality of outdoor units are installed (S52), selecting a corresponding test operation mode among a plurality of test operation modes preset according to an average indoor temperature of the detected plural indoor temperatures and an average outdoor temperature of the detected plural outdoor temperatures (S53), test-operating the multi-type air conditioner according to the selected test operation mode (S54) and collecting data showing an operation state of the test-operated air conditioner (S55), and comparing the collected data with a preset reference data (S56) and judging an abnormal state of the multi-type air conditioner based on the comparison result (S57).

The method for detecting an abnormal state of a multi-type air conditioner further comprises previously storing ideal data that indicates a normal operation state of the multi-type air conditioner as a reference data, and previously storing information of first to sixth zones divided according to the average indoor temperature and the average outdoor temperature and having different test operation modes. Also, the method for detecting an abnormal state of a multi-type air conditioner further comprises displaying an abnormal state of the multi-type air conditioner judged by the micro computer 100.

The multi-type air conditioner can be realized as several systems. However, the multi-type air conditioner according to the present invention is realized as a heat pump system (HPS). Hereinafter, the multi-type air conditioner realized as a heat pump system will be explained.

Since the multi-type air conditioner according to the present invention is realized as a heat pump system, data for showing an operation state of the multi-type air conditioner includes characteristic values of the heat pump system operated in a cooling mode or a heating mode, that is, a value of a high pressure ($P_H$), a value of a low pressure ($P_L$), a value of a compressor discharge temperature, a value of a liquid pipe temperature, a value of a degree of sub-cooling, a value of a degree of superheat, etc. Referring to FIG. 1, the value of a high pressure ($P_H$) denotes a value of a pressure between the check valve 33 and the four-way valve 21. The value of a low pressure ($P_L$) denotes a value of a pressure between the four-way valve 21 and the accumulator 27. Also, the value of a compressor discharge temperature is a value of a temperature between the first and second compressors 13*a* and 13*b* and the oil separator 31. The value of a compressor discharge temperature is measured only for compressors being operated, and the value of a liquid pipe temperature denotes a value of a temperature between the service valve 43*a* and the outdoor heat exchanger 25. The value of a degree of sub-cooling denotes a difference between the liquid pipe temperature and a saturated temperature corresponding to the value of a high pressure $P_H$ on a pressure-enthalpy diagram. Also, the value of degree of superheat denotes a difference between a saturated temperature corresponding to the value of a low pressure $P_L$ and a suction temperature of the compressor on a pressure-enthalpy diagram. The suction temperature of the compressor is measured at an inlet of the first compressor 13*a,* an inlet of the second compressor 13*b,* or an inlet of the accumulator 27.

The method for detecting an abnormal state of a multi-type air conditioner according to the present invention will be explained in more detail.

Ideal data at the time of operating the heat pump system is detected by an experiment or by a theory, and the detected ideal data is preset as a reference data.

Under the state, if a user selects a test-operation of the multi-type air conditioner (S51), the plural indoor temperature sensors (RT1~RTn) detect indoor temperatures of the indoor zones where the plural indoor units are installed and the plural outdoor temperature sensors (0T1~0Tn) detect outdoor temperatures of the outdoor zones where the plural outdoor units are installed (S52). The user's test operation selection is performed through a key inputting unit of a controller of the outdoor unit or through an external person computer (PC), or through a mobile communication terminal.

Then, the micro computer 100 calculates a weighted average indoor temperature of the detected indoor temperatures and an arithmetic average outdoor temperature of the detected outdoor temperatures, and selects a test operation mode of the multi-type air conditioner according to the calculated average indoor temperature and the average outdoor temperature with reference to FIG. 4 (S53). The test operation mode is divided into 6 modes according to that the average indoor temperature and the average outdoor temperature belong to which zone among the first to sixth zones of FIG. 4.

Then, the micro computer 100 operates the multi-type air conditioner in the selected test operation mode (S54). That is, when the average indoor temperature and the average outdoor temperature correspond to the first zone, the multi-type air conditioner is operated in a cooling mode for a preset time thereby to lower the average indoor temperature by a preset temperature. Then, it is judged whether the average outdoor temperature and the lowered average indoor temperature correspond to the second zone. If the average outdoor temperature and the lowered average indoor temperature correspond to the second zone, the multi-type air conditioner is test-operated in a test operation mode corresponding to the second zone. However, if the average outdoor temperature and the lowered average indoor temperature do not correspond to the second zone, the test-operation of the multi-type air conditioner is stopped and the stopped state of the multi-type air conditioner is displayed.

In a test-operation mode of the multi-type air conditioner when the average indoor temperature and the average outdoor temperature correspond to the second zone, only half of the plural indoor units are operated in a cooling mode for a preset time and the rest half of the plural indoor units are not operated. A step for operating the indoor units for a preset number of times with alternation is further comprised.

In a test-operation mode of the multi-type air conditioner when the average indoor temperature and the average outdoor temperature correspond to the third zone, all the plural indoor units are operated in a cooling mode for a preset time. It is also possible to operate some indoor units (for example, 50%) for a preset time before operating all the plural indoor units.

In a test-operation mode of the multi-type air conditioner when the average indoor temperature and the average outdoor temperature correspond to the fourth zone, all the plural indoor units are operated in a heating mode for a preset time. It is also possible to operate some indoor units (for example, 50%) for a preset time before operating all the plural indoor units.

In a test-operation mode of the multi-type air conditioner when the average indoor temperature and the average outdoor temperature correspond to the fifth zone, only half of the plural indoor units are operated in a heating mode for a preset time and the rest of the plural indoor units are not operated. A step for operating the indoor units for a preset number of times with alternation is further comprised.

When the average indoor temperature and the average outdoor temperature correspond to the sixth zone, the multi-type air conditioner is operated in a heating mode for a preset time thereby to increase the average indoor temperature by a preset temperature. Then, it is judged whether the average outdoor temperature and the increased average indoor temperature correspond to the fifth zone. If the average outdoor temperature and the increased average indoor temperature correspond to the fifth zone, the multi-type air conditioner is test-operated in a test operation mode corresponding to the fifth zone. However, if the average outdoor temperature and the increased average indoor temperature do not correspond to the fifth zone, the test-operation of the multi-type air conditioner is stopped and the stopped state of the multi-type air conditioner is displayed.

Then, the micro computer 100 collects data showing an operation state of the multi-type air conditioner operated in the selected test operation mode (S55), and compares the collected data with a preset reference data (S56), thereby judging an abnormal state of the multi-type air conditioner based on the comparison result. Then, the micro computer 100 displays the abnormal state of the multi-type air conditioner (S57). The micro computer 100 stops the multi-type air conditioner when it is judged that the multi-type air conditioner is in an abnormal state. On the contrary, when it is judged that the multi-type air conditioner is in a normal state, the micro computer 100 stops the test operation of the multi-type air conditioner after collecting oil inside the multi-type air conditioner. Since the multi-type air conditioner according to the present invention is realized as a heat pump system, data for showing an operation state of the multi-type air conditioner includes characteristic values of the heat pump system operated in a cooling mode or a heating mode, that is, a value of a high pressure ($P_H$), a value of a low pressure ($P_L$), a value of a compressor discharge temperature, a value of a liquid pipe temperature, a value of a degree of sub-cooling, a value of a degree of superheat, etc.

Then, the micro computer 100 compares the data for showing an operation state of the multi-type air conditioner test-operated by the several test-operation modes with a preset reference data, and judges an abnormal state of the multi-type air conditioner on the basis of the comparison result.

For example, when an error between the data for indicating an operation state of the multi-type air conditioner and the preset reference data is more than 30% as the result of the comparison, the micro computer judges as that the multi-type air conditioner is in an abnormal state.

As aforementioned, the multi-type air conditioner is operated in different test modes according to the indoor temperatures and the outdoor temperatures, and the data for showing an operation state of the multi-type air conditioner is compared with the preset reference data, thereby judging an abnormal state of the multi-type air conditioner.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. An abnormal state detecting apparatus of a multi-type air conditioner, the apparatus comprising:

a plurality of indoor temperature sensors that detect indoor temperatures;

a plurality of outdoor temperature sensors that detect outdoor temperatures; and a micro computer that determines an abnormal state of the multi-type air conditioner by selecting a test operation mode from a plurality of preset test operation modes, the selected test operation mode corresponding to a previously detected indoor temperature and a previously detected outdoor temperature, by test-operating the multi-type air conditioner according to the selected test operation mode, by collecting data showing an operation state of the test-operated air conditioner, and then by comparing the collected data with preset reference data, wherein the plurality of test operation modes correspond to first to sixth zones, each of the first through sixth zones having different test operation modes, wherein the first through the sixth zones are divided based on an average indoor temperature of a plurality of indoor temperatures detected by the plurality of indoor temperature sensors and an average outdoor temperature of a plurality of outdoor temperatures detected by the plurality of outdoor temperatures.

2. The apparatus of claim 1, wherein the data collected comprises characteristic values of the multi-type air conditioner operated in a cooling mode or a heating mode, including a high pressure value, a low pressure value, a compressor discharge temperature value, a liquid pipe temperature value, a degree of sub-cooling value, and a degree of superheat value.

3. The apparatus of claim 1, wherein the micro computer stops the multi-type air conditioner when the multi-type air conditioner is in an abnormal state, and wherein the microcomputer stops the multi-type air conditioner after performing the test-operation when the multi-type air conditioner is in a normal state.

4. The apparatus of claim 1, further comprising:

display that displays an abnormal state of the multi-type air conditioner.

5. The apparatus of claim 1, further comprising:

a storing unit that receives and stores preset ideal data that indicates a normal operation state of the multi-type air conditioner as reference data, and that receives and stores preset information of first to sixth zones divided according to the average indoor temperature and the average outdoor temperature and having different test operation modes.

6. The apparatus of claim 5,

Wherein, in the first zone, the microcomputer operates the multi-type air conditioner in a cooling mode for a first preset time, and then converts the test-operation to the second zone or stops the test-operation;

in the second zone, the microcomputer operates only half of a plurality of indoor units in a cooling mode for a second preset time and does not operate a remaining half of the plurality of indoor units, in the third zone, the microcomputer operates all of the plurality of indoor units in a cooling mode for a third preset time, in the fourth zone, the microcomputer operates all of the plurality of indoor units in a heating mode for a fourth preset time;

in the fifth zone, the microcomputer operates only half of the plurality of indoor units in a heating mode for a fifth preset time and does not operate a remaining half of the plurality indoor units, and in the sixth zone, the microcomputer operates the multi-type air conditioner in a heating mode for a sixth preset time, and then converts the test-operation to the fifth zone or stops the test-operation.

7. A method for detecting an abnormal state of a multi-type air conditioner, the method comprising:

detecting a plurality of indoor and outdoor temperatures when a test operation mode starts;

selecting a test operation mode from a plurality of preset test operation modes, wherein the selected test operation mode corresponds to the detected indoor and outdoor temperatures;

test-operating the multi-type air conditioner according to the selected test operation mode, and collecting data showing an operation state of the test-operated air conditioner; and comparing the collected data with preset reference data and determining an abnormal state of the multi-type air conditioner based on a result of the comparison, wherein each of the plurality of the test operation modes are based on an average indoor temperature and an average outdoor temperature corresponding to one of a first through sixth zone.

8. The method of claim 7, wherein the average indoor temperature is an average value of the detected plurality of indoor temperatures, and the average outdoor temperature is an average value of the detected plurality of outdoor temperatures.

9. The method of claim 7, wherein the collected data comprises characteristic values of the multi-type air conditioner operated in a cooling mode or a heating mode, including a high pressure value, a low pressure value, a compressor discharge temperature value, a liquid pipe temperature value, a degree of sub-cooling value, and a degree of superheat value.

10. The method of claim 7, wherein the test operation in the first zone comprises:

operating the multi-type air conditioner in a cooling mode for a first preset time so as to lower the average indoor temperature by a preset amount, and then determining whether the average outdoor temperature and the lowered average indoor temperature correspond to the second zone;

test-operating the multi-type air conditioner in a test operation mode corresponding to the second zone when the average outdoor temperature and the lowered average indoor temperature correspond to the second zone as a result of the determination; and stopping the test-operation of the multi-type air conditioner and displaying the stopped state of the test-operation when the average outdoor temperature and the lowered average indoor temperature do not correspond to the second zone as a result of the determination.

11. The method of claim 10, wherein the test operation in the second zone comprises:

operating only half of a plurality of indoor units in a cooling mode for a second preset time; and not operating a remaining half of the plurality of indoor units for the second preset time.

12. The method of claim 11, wherein the operating and not operating steps are alternately and repeatedly performed for a preset number of times.

13. The method of claim 7, wherein in the third zone, all of the plurality of indoor units are operated in a cooling mode for a third preset time.

14. The method of claim 13, wherein, in the third zone, some of the plurality of indoor units are operated for a preset time before all of the plurality of indoor units are operated in a cooling mode.

15. The method of claim 7, wherein, in the fourth zone, all of the plurality of indoor units are operated in a heating mode for a fourth preset time.

16. The method of claim 15, wherein, in the fourth zone, some of the plurality of indoor units are operated for a preset time before all of the plurality of indoor units are operated in a heating mode.

17. The method of claim 7, wherein the test operation in the fifth zone comprises:

operating only half of the plurality of indoor units in a heating mode for a fifth preset time; and not operating a remaining half of the plurality of indoor units for the fifth preset time.

18. The method of claim 17, wherein the operating and not operating steps of the fifth zone are alternately and repeatedly performed for a preset number of times.

19. The method of claim 7, wherein the test operation in the sixth zone comprises:

operating the multi-type air conditioner in a heating mode so as to increase the average indoor temperature by a preset amount, and then determining whether the average outdoor temperature and the increased average indoor temperature correspond to the fifth zone;

operating the multi-type air conditioner in a test operation mode corresponding to the fifth zone when the average outdoor temperature and the increased average indoor temperature correspond to the fifth zone as a result of the determination; and stopping the test-operation of the multi-type air conditioner and displaying the stopped state of the test-operation when the average outdoor temperature and the increased average indoor temperature do not correspond to the fifth zone as a result of the determination.

20. The method of claim 7, further comprising:

stopping the multi-type air conditioner when the multi-type air conditioner is in an abnormal state; and stopping the multi-type air conditioner after performing the test-operation when the multi-type air conditioner is in a normal state.

21. The method of claim 7, further comprising:

pre-storing ideal data corresponding to an operation state of the multi-type air conditioner as reference data; and pre-storing information associated with the first through sixth zones, wherein the first through sixth zones are distinguished from one another based on average indoor and outdoor temperatures and different test operation modes.

* * * * *